US005727252A

United States Patent [19]

Oetting et al.

[11] Patent Number: 5,727,252

[45] Date of Patent: Mar. 17, 1998

[54] PADDED KNEE GUARD

[75] Inventors: Richard H. Oetting, St. Louis Park; Corinne A. Cerull, Minneapolis, both of Minn.

[73] Assignee: Rollerblade, Inc., Minneapolis, Minn.

[21] Appl. No.: 741,654

[22] Filed: Oct. 31, 1996

[51] Int. Cl.[6] ..... A41D 13/06

[52] U.S. Cl. ..... 2/24; 2/911

[58] Field of Search ..... 2/24, 911, 908; 602/63, 62, 26, 23

[56] References Cited

U.S. PATENT DOCUMENTS

| | | | |
|---|---|---|---|
| D. 255,728 | 7/1980 | Baron . | |
| D. 338,280 | 8/1993 | Krent et al. . | |
| D. 341,005 | 11/1993 | Pratt . | |
| D. 341,679 | 11/1993 | Levine . | |
| D. 341,681 | 11/1993 | Levine . | |
| D. 343,480 | 1/1994 | Levine . | |
| D. 346,245 | 4/1994 | Krent et al. . | |
| D. 347,301 | 5/1994 | Levine . | |
| D. 373,655 | 9/1996 | Kalvestran et al. . | |
| 1,351,731 | 9/1920 | Baldwin . | |
| 2,013,622 | 2/1935 | Walker | 2/24 |
| 2,188,718 | 1/1940 | Jung | 2/24 |
| 2,550,461 | 4/1951 | Fick . | |
| 3,416,156 | 12/1968 | Marvid . | |
| 3,463,147 | 8/1969 | Stubbs . | |
| 3,465,365 | 9/1969 | Jones et al. . | |
| 3,735,419 | 5/1973 | Byrd . | |
| 3,945,047 | 3/1976 | Jarrell, Jr. . | |
| 4,151,614 | 5/1979 | Rhee . | |
| 4,484,361 | 11/1984 | Leighton et al. . | |
| 4,490,855 | 1/1985 | Figgie, III et al. . | |
| 4,593,416 | 6/1986 | Figgie, III et al. . | |
| 4,599,747 | 7/1986 | Robinson . | |
| 4,599,748 | 7/1986 | Garcia . | |
| 4,627,108 | 12/1986 | Jarvinen . | |
| 4,633,529 | 1/1987 | Litz | 2/24 |
| 4,685,153 | 8/1987 | Sims . | |
| 4,692,946 | 9/1987 | Jurga . | |
| 4,751,748 | 6/1988 | Ekins . | |
| 4,796,303 | 1/1989 | Atwater . | |
| 4,884,561 | 12/1989 | Letson, Sr. . | |
| 4,888,826 | 12/1989 | Parsons, Jr. et al. . | |
| 4,914,753 | 4/1990 | Chang | 2/24 |
| 4,926,501 | 5/1990 | Goosen . | |
| 4,953,569 | 9/1990 | Lonardo . | |
| 4,986,263 | 1/1991 | Dickerson et al. . | |
| 4,999,847 | 3/1991 | Barcelo . | |
| 5,016,621 | 5/1991 | Bender . | |
| 5,024,216 | 6/1991 | Shiono . | |
| 5,065,457 | 11/1991 | Henson . | |
| 5,255,391 | 10/1993 | Levine . | |
| 5,472,413 | 12/1995 | Detty | 2/24 |
| 5,500,955 | 3/1996 | Gongea | 2/24 |

FOREIGN PATENT DOCUMENTS

| | | | |
|---|---|---|---|
| 967302 | 5/1975 | Canada . | |
| 440367 | 12/1935 | United Kingdom | 2/24 |
| 2073009 | 10/1981 | United Kingdom . | |

OTHER PUBLICATIONS

1995 Product Catalog of Pro Designed.

*Primary Examiner*—C. D. Crowder
*Assistant Examiner*—Larry D. Worrell, Jr.
*Attorney, Agent, or Firm*—Merchant, Gould, Smith, Edell, Welter & Schmidt, P.A.

[57] ABSTRACT

A knee pad includes first and second protective paddings hinged to another. A stretchable fabric has an edge secured to an edge of both the first and second paddings. An opposite edge of the fabric has releasable fasteners for releasably securing the opposite fabric edge to opposite edges of the paddings.

9 Claims, 3 Drawing Sheets

PADDED KNEE GUARD

I. BACKGROUND OF THE INVENTION

1. Field of the Invention

This invention pertains to protective wear for use during sporting activities. More particularly, this invention pertains to a guard for protecting a wearer's joint such as a knee.

2. Description of the Prior Art

Knee guards for protecting a wearer's knees during sporting activities are well known. Examples of such appear in U.S. Pat. No. 4,484,361; 3,945,047 and U.S. Pat. No. Design 373,655.

In recent years, rollerskating and in-line skating have become extremely popular. Participants in these sports desire knee protection in the event of a fall. Skaters who skate on hard surfaces such as asphalt, concrete or the like may fall subjecting the knee to injury. Joint protection is desired to protect against impact injury as well as abrasion. Also, such protection must permit easy flexion of the joint during normal skating as well as provide comfort for the wearer. Such protection is also of increased interest in so-called "extreme" skating where skaters perform acrobatic acts such as flips or the like.

II. SUMMARY OF THE INVENTION

According to a preferred embodiment of the present invention, a knee pad includes a first protective padding sized to cover a knee of a user with the first protective padding positioned over the front of the knee and extending downwardly to cover an upper portion of the lower leg of the user. A second padding is hinged to the first padding. The second padding is positioned and sized to cover a lower portion of an upper leg of the user when the first padding is positioned over the front of the knee. A stretchable fabric has a first edge secured to the edges of the paddings. The fabric is sized to extend from the paddings around the back of the knee and to be releasably fastened to the paddings.

III. BRIEF DESCRIPTION OF THE DRAWINGS

IV. DESCRIPTION OF THE PREFERRED EMBODIMENT

Figure 1:
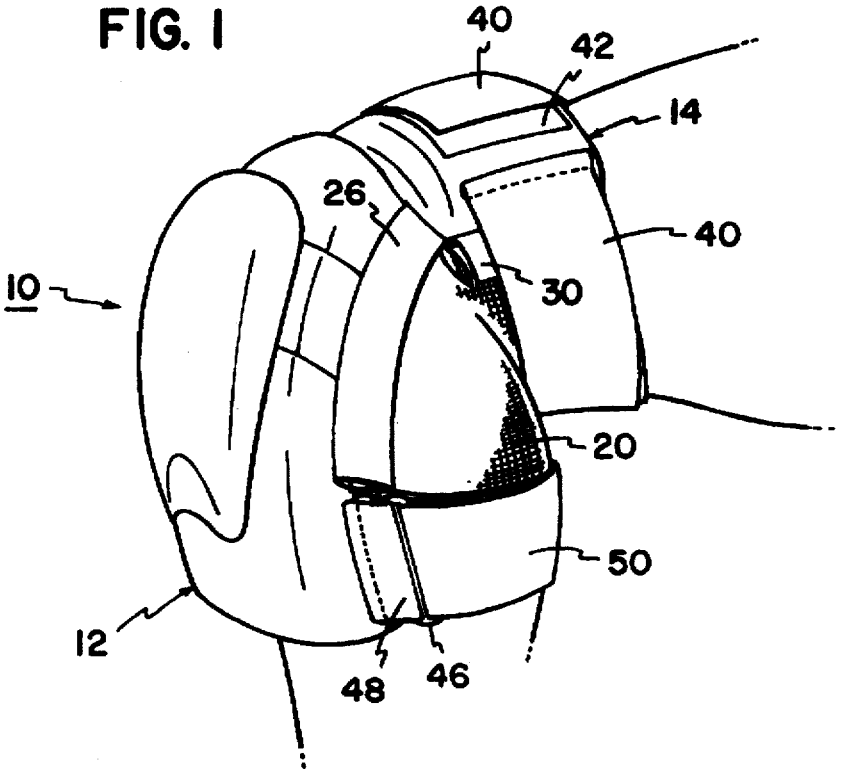
FIG. 1 is a front, top and left side perspective view of a knee pad according to the present invention shown in use on a right knee of a user.
Figure 2:
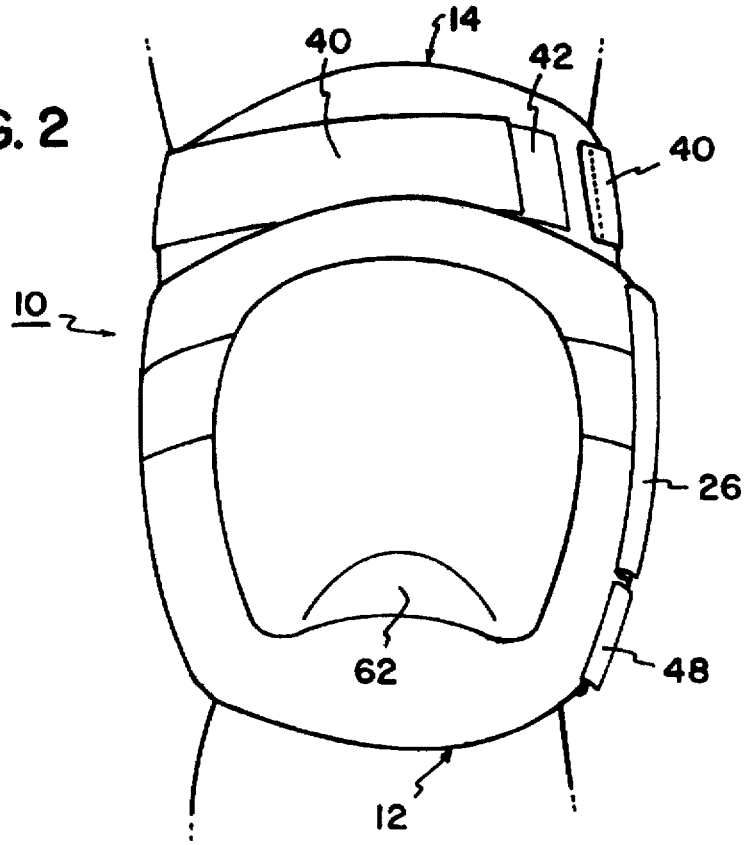
FIG. 2 is a front elevation view of the pad of FIG. 1.
Figure 3:
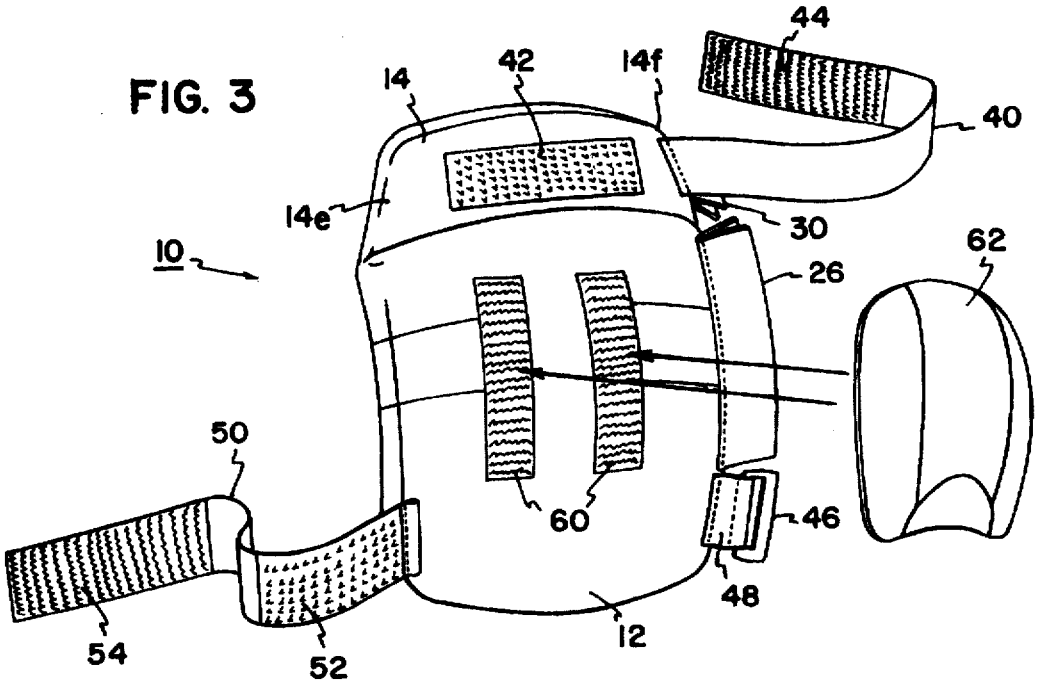
FIG. 3 is a front elevation view of the pad according to the present invention with an impact cover removed.
Figure 4:
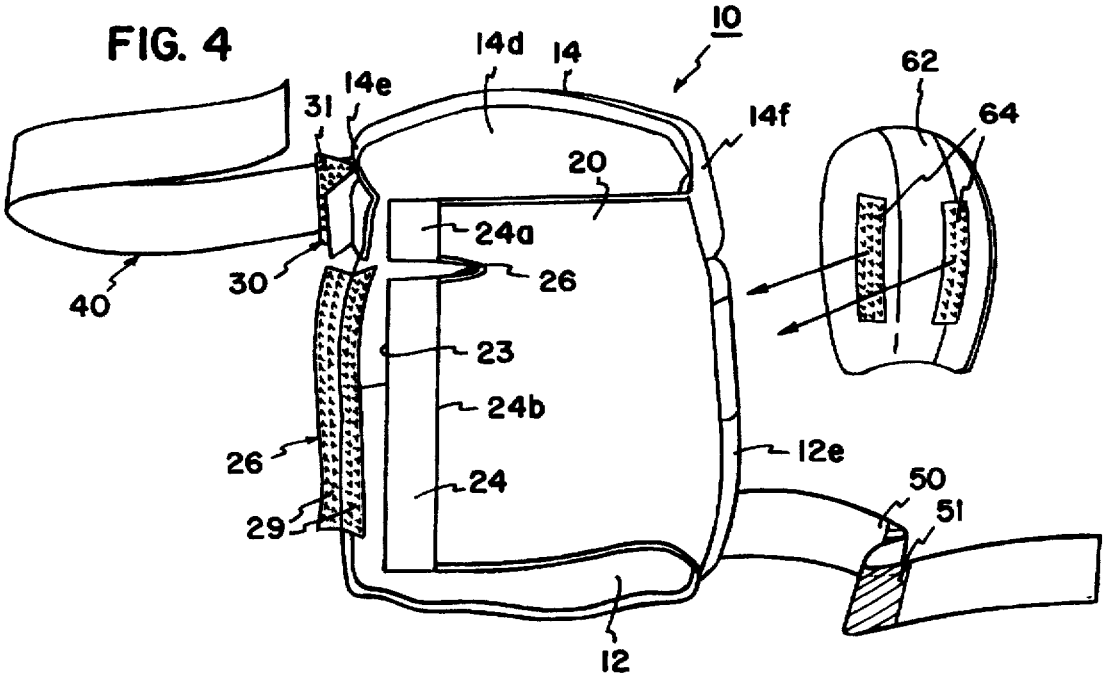
FIG. 4 is a rear elevation view of the pad of FIG. 3.

With reference to all the various drawing figures in which identical elements are numbered identically throughout, a description of the preferred embodiment invention will now be provided.

In the figures, a knee guard or knee pad 10 is shown, including a first protective padding 12 and a second protective padding 14. Paddings 12 and 14 are formed of cushioned foam material 12', 14' enclosed in fabric liners 15 and 17.

The pad 12 presents an inner concave surface **12*a* sized to cover the front of a user's knee. The pad 12 has an outer convex surface 12*b* and opposite sidewalls 12*c*, 12*d*, top wall 12*e* and bottom wall 12*f*. Similarly, pad 14 has a flat inner surface 14*a*, flat outer surface 14*b*, a top surface 14*c*, bottom surface 14*d* and side surface 14*e*, 14*f***.

Figure 5:
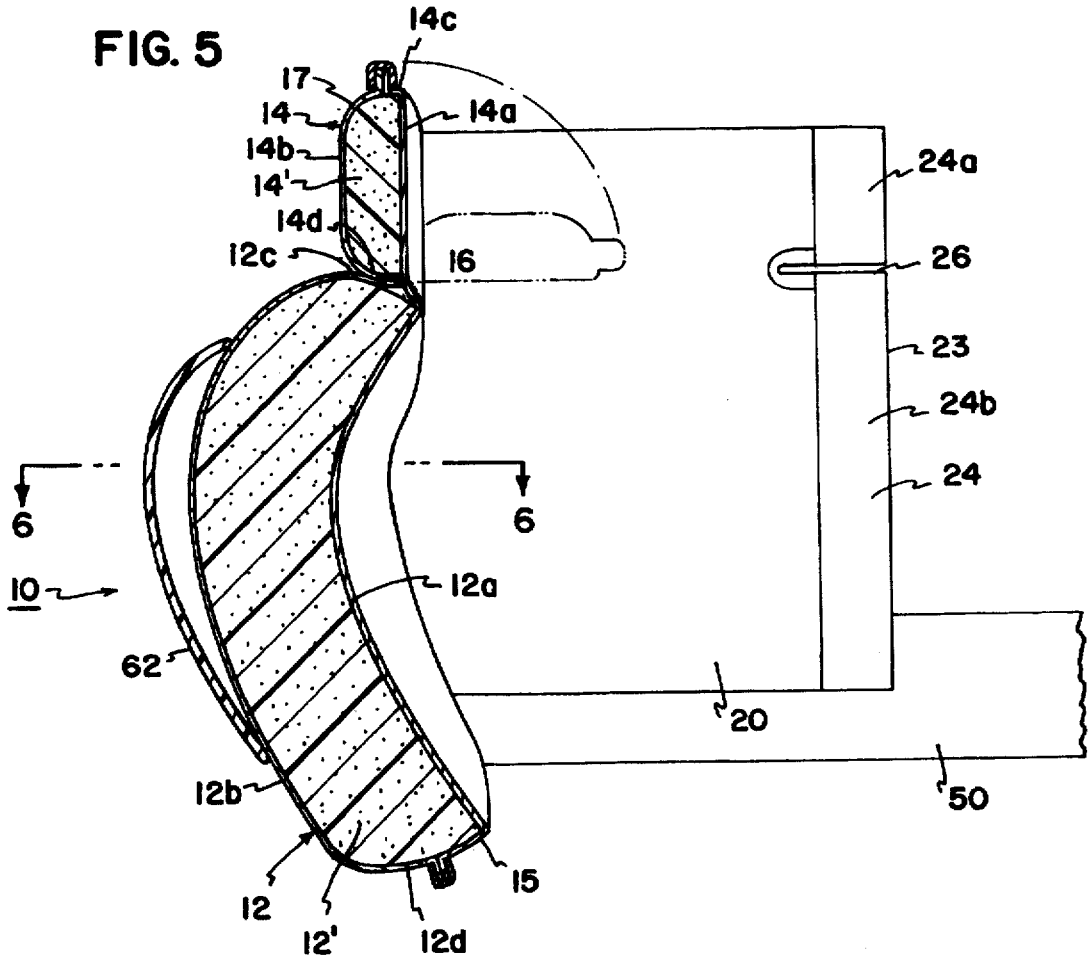
FIG. 5 is a side sectional view of the pad of FIG. 3.

Fabrics 15 and 17 are stitched together at walls **12*c* and 14*d* to define a hinge 16 between an upper edge 12*c* of pad 12 and a lower edge 14*d* of pad 14 such that pad 14 may pivot relative to pad 12 as illustrate by the phantom lines in FIG. 5. The second pad 14 is sized to cover a lower portion of an upper leg of a user when the first pad 12** is positioned over the user's knee.

A first side **12*e*, 14*e* of the pads 12, 14 define a pad edge. Stitched to the pad edge (at the intersection of surfaces 12*a*, 12*e* and 14*a*, 14*e*) is a first edge 22 of a sheet 20 of stretchable fabric best illustrated in FIG. 6. An opposite edge 23 of the fabric 20 is provided with a hook and loop fastener 24 (such as fasteners sold under the well-known trademark VELCRO™) on both sides of fabric 20. A slit 27 is formed through the loop fastener 24 and partly into the fabric 20 along a line which is in-line with the hinge 16. The slit 27 divides the loop fastener 24 into an upper portion 24*a* aligned with pad 14 and a lower portion 24*b* aligned with pad 12**.

Figure 6:
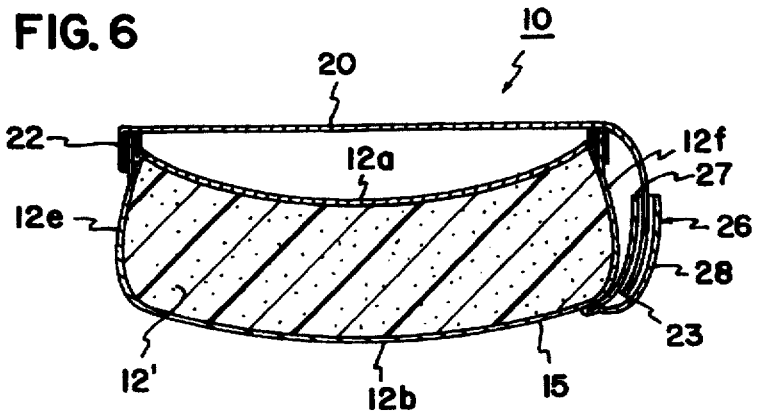
FIG. 6 is a view taken along line 6—6 of FIG. 5 with omission of the impact cover.

As best shown in FIG. 6, the thickness of the cushion 12 separates the pad 12 into a rear surface **12*a* and a front surface 12*b* as well as side surfaces 12*e* and 12*f*. Adjacent to intersection of sides 12*b* and 12*f*, a first flap 26 is stitched to the padding fabric 15**.

The flap 26 is generally V-shaped in cross-sectioned to provide a first flap 27 and a second flap 28, both having hook fasteners 29 on their opposing inner surfaces with the hook fasteners 29 selected to mate with the loop fastener **24*b* which is positioned on opposite sides of the fabric 20. Similarly, a V-shaped flap 30 having its apex stitched to fabric 17 at the intersection of surfaces 14*a* and 14*e*, is provided with hook fasteners 31 to mate with the loop fastener 24*a* on sheet 20**.

The knee pad 10 can be placed in front of a user's knee with knee received within concave surface **12*a*. The fabric 20 is stretched around the back of a user's leg and the loop fastener 24*b* received within V-shaped flap 26 with hook fastener 24*b* on both sides of fabric 20 being secured to the opposing hook fasteners 29 on the V-shaped flap 26. Likewise, the loop fastener 24*a* can be received within the upper V-flap 30 and secured to the hook fastener 31**.

In addition to securing the pad 10 to the user's leg in the manner above described, an upper strap 40 is stitched to the fabric 17 of upper pad 14 at the intersection of surface **14*b* and 14*e*. The strap 40 is sized to extend around the back of the user's upper leg and extend over the front 14*b* of the upper pad 14. The upper pad 14, on its forward surface 14*b*, is provided with a hook fastener 42 and the strap 40 is provided with a mating loop fastener 44 to releasably secure the strap 40 to the pad 14**.

The lower edge of the first pad 12 includes a ring 46 secure to the pad 14 by a short strap 48 stitched to both the pad 12 and to the ring 46 (at the intersection of surface **12*b* and 12*f*). An elongated strap 50 with canvas reinforcement 51 is stitched to an opposite side of the pad 12 at the intersection of surfaces 12*b* and 12*e*. The elongated strap 50 is sized to extend around the back of the user's lower leg and be received through the ring 46 and folded over onto itself behind the leg of the user. The elongated strap 50 has a first field 52 of a hook fastener and a second field 54 of a mating loop fastener such that the strap 50 can be folded over onto itself and secured in a desired position of tightening. In a preferred embodiment, the upper strap 40 is elastic and the lower strap 50 is non-elastic. Also, in a preferred embodiment, the fabric 20 is preferably a sewable, four-way stretchable fabric such as DuPont's LYCRA® blended fabrics. The upper foam material 14' preferably has a density of 1.03 grams per square inch while the foam 12' of the lower pad 12** preferably has a density of about 0.44 grams per square inch.

The front face 126 of the lower padding 12 includes hook and loop fastener strips 60. An abrasive resistant high impact plastic shell 62 is provided with mating pressure sensitive adhesive hook fastener strips 64 (such as SCOTCHMATE SJ-3526 of 3M Corporation) to mate with the loop fastener strips 60 on the pad 12. The shell 62 is positioned to cover the knee of the user when the pad 10 is secured to the knee and leg.

With the structure thus described, an improved knee pad 10 is disclosed. The pad 10 includes an abrasive resistant shell 62 positioned over the knee to absorb abrasive impact and prevent abrasive damage. The pad 10 includes a dense foam 14', 12' for protecting the knee from impact as well as protecting the upper leg. The structure of the pad secures the pad 10 to the knee and leg in a manner far superior to that previously available. For example, the stretchable fabric 20 (also referred to as a sock) is not secured with both of its edges permanently secured to the pad 10 such that a user must stretch the material when placing the user's foot and leg through the sock 20. Instead, one end 23 of the sock 20 is releasable at the flaps 26, 30. As a result, the pad 10 is easier to place on the leg of the user. Further, hook and loop fasteners **24*a*, 24*b* are being attached to mating hook and loop fasteners 31, 29, both sides of the fabric 20 are secured along the entire length of edge 23, to the V-shaped flaps 26, 30. Therefore, greater strength of attachment is provided. Also, the sock 20 covers both the lower leg, knee and upper leg of the user to provide greater surface area for attachment as well as for comfort. Since the V-shaped flaps 26, 30 are separate and the slit 27 is formed in the fabric 20 to align with the hinge joint 16, there is a high degree of flexibility between the upper and lower paddings 12, 14. In addition to the above, the straps 40, 50 provide further secure attachment of the knee pad 10** to the leg.

From the foregoing detailed description the present invention it has been shown how the invention has been attached in the preferred manner. However, modifications and equivalents of the disclosed concepts such as those which readily occur in one skilled in the art are appended to be included within the scope of the claims which are appended hereto.

What is claimed is:

1. A knee pad comprising:

a first protective padding having first and second padding edges, said first padding sized to cover a knee of a user with said first padding positioned over a front of said knee and extending downwardly to cover an upper portion of a lower leg of said user;

a second padding having first and second padding edges, said second padding hinged to said first padding with said second padding positioned and sized to cover a lower portion of an upper leg of said user when said first padding is positioned over said front of said knee, wherein said first and second padding edges of said second padding are substantially aligned with said first and second padding edges, respectively, of said first padding;

a stretchable fabric having first and second fabric edges defining a width of said fabric therebetween, said first fabric edge secured to said first padding edges of both of said first and second paddings with said fabric sized to extend substantially continuously from said first padding edge of said first padding along said width of said fabric and around a back of said knee to said second fabric edge adjacent to said second padding edge of said first padding, said fabric further sized to cover said back of said knee and portions of back sides of said upper and lower legs;

said second fabric edge and said second padding edge including a first and second set of releasable fasteners for releasably securing said second fabric edge to said second padding edge.

2. A knee pad according to claim 1 wherein said first and second sets of releasable fasteners includes a first mating pair of hook and loop fasteners and a second mating pair of hook and loop fasteners.

3. A knee pad according to claim 2 wherein one of said first mating pair is secured to said second padding edge on said first padding and an other of said first mating pair is secured to said second fabric edge opposing said first padding; and one of said second mating pair is secured to said second padding edge on said second padding and an other of said second mating pair is secured to said second fabric edge opposing said second padding.

4. A knee pad according to claim 3 wherein said fabric includes a slot formed through said second fabric edge between said others of said first and second mating pairs.

5. A knee pad according to claim 3 wherein said other of said first mating pair is secured to both a front and a rear side of said fabric at said second fabric edge;

said second padding edge includes a first flap positioned to cover said second padding edge on said first padding;

said one of said first mating pair is secured to both said first flap and said second padding edge on said first padding.

6. A knee pad according to claim 5 wherein said other of said second mating pair is secured to both a front and a rear side of said fabric at said second fabric edge;

said second padding edge includes a second flap positioned to cover said second padding edge on said second padding;

said one of said second mating pair is secured to both said first flap and said second padding edge on said second padding.

7. A knee pad according to claim 1 comprising an abrasion resistant plate secured to said first padding.

8. A knee pad comprising:

a protective padding having first and second padding edges, said padding sized to cover a knee of a user and positioned over a front of said knee;

a stretchable fabric having first and second fabric edges defining a width of said fabric therebetween, said first fabric edge secured to said first padding edge of said padding with said fabric sized to extend substantially continuously from said first padding edge of said padding along said width of said fabric and around a back of said knee to said second fabric edge adjacent to said second padding edge of said padding, said fabric further sized to cover said back of said knee;

said second fabric edge and said second padding edge including a first set of releasable fasteners for releasably securing said second fabric edge to said second padding edge.

9. A knee pad comprising:

a protective padding having first and second padding edges, said padding sized to cover a knee of a user and positioned over a front of said knee;

a stretchable fabric having first and second fabric edges and having front and rear sides, said first fabric edge secured to said first padding edge of said padding with said fabric sized to extend from said first padding edge and around a back of said knee to said second fabric edge adjacent to said second padding edge of said padding, said fabric further sized to cover said back of said knee;

said second fabric edge and said second padding edge including a first set of releasable fasteners for releasably securing said second fabric edge to said second padding edge;

wherein said first set of releasable fasteners includes a mating pair of hook and loop fasteners for releasably securing said second fabric edge to said second padding edge;

one of said mating pair is secured to said second padding edge on said padding and an other of said mating pair is secured to said second fabric edge opposing said padding;

said other of said mating pair is secured to both said front and said rear side of said fabric at said second fabric edge;

said second padding edge includes a flap positioned to cover said second padding edge on said padding; and said one of said mating pair is secured to both said flap and said second padding edge on said padding.

* * * * *

UNITED STATES PATENT AND TRADEMARK OFFICE

CERTIFICATE OF CORRECTION

PATENT NO. : 5,727,252

DATED : MARCH 17, 1998

INVENTOR(S) : OETTING ET AL.

It is certified that error appears in the above-identified patent and that said Letters Patent is hereby corrected as shown below:

In column 2, line 1: "opposite sidewalls" should read —top and bottom surfaces—.

In column 2, lines 1 and 2: "top wall 12*e* and bottom wall 12*f*." should read —and opposite side surfaces 12*e*, 12*f*.—

In column 2, line 18: "27" should read —25—.

In column 2, line 20: "27" should read —25—.

In column 2, line 49: "surface" should read —surfaces—.

In column 2, line 50: "14*e*" should read —14*f*—.

In column 2, line 57: "secure" should read —secured—.

In column 2, line 58: "surface" should read —surfaces—.

In column 3, line 9: "126" should read —12*b*—.

In column 3, line 37: "27" should read —25—.

Signed and Sealed this

Eleventh Day of May, 1999

*Attest:*

Q. TODD DICKINSON

*Attesting Officer*

*Acting Commissioner of Patents and Trademarks*